US010309129B2

(12) United States Patent
Suholutskaja et al.

(10) Patent No.: US 10,309,129 B2
(45) Date of Patent: Jun. 4, 2019

(54) MOTOR VEHICLE DOOR LOCK

(71) Applicant: Kiekert Aktiengesellschaft, Heiligenhaus (DE)

(72) Inventors: Elena Suholutskaja, Dusseldorf (DE); Johannes Theodor Menke, Velbert (DE); Xinlei Wang, Heiligenhaus (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 452 days.

(21) Appl. No.: 15/027,798

(22) PCT Filed: Oct. 7, 2014

(86) PCT No.: PCT/DE2014/100350
§ 371 (c)(1),
(2) Date: Apr. 27, 2016

(87) PCT Pub. No.: WO2015/051782
PCT Pub. Date: Apr. 16, 2015

(65) Prior Publication Data

US 2016/0237722 A1 Aug. 18, 2016

(30) Foreign Application Priority Data

Oct. 9, 2013 (DE) ..... 10 2013 220 382

(51) Int. Cl.
*E05B 77/06* (2014.01)
*E05B 79/10* (2014.01)
(Continued)

(52) U.S. Cl.
CPC ..... *E05B 79/10* (2013.01); *E05B 77/06* (2013.01); *E05B 85/243* (2013.01); *E05B 85/26* (2013.01);
(Continued)

(58) Field of Classification Search
CPC ..... Y10S 292/22; E05B 77/02; E05B 77/04; E05B 77/06
(Continued)

(56) References Cited

U.S. PATENT DOCUMENTS 3,799,596 A * 3/1974 Nozomu ..... E05B 77/06 180/286
4,536,021 A * 8/1985 Mochida ..... E05B 77/12 292/201
(Continued)

FOREIGN PATENT DOCUMENTS

CN 1754033 A 3/2006
CN 1782309 A 6/2006
(Continued)

OTHER PUBLICATIONS

Machine Translation of DE19902561A1 by Lexis Nexis Total Patent on Apr. 22, 2016.
(Continued)

*Primary Examiner* — Carlos Lugo
(74) *Attorney, Agent, or Firm* — Woodard, EMhardt, Henry, Reeves & Wagner, LLP

(57) ABSTRACT

The invention relates to a motor vehicle door lock with a locking mechanism comprising a rotary latch and a pawl, a trigger lever which acts on the pawl, a blocking lever which acts on the trigger lever, a first actuating lever which acts on the trigger lever and which acts on the blocking lever via a first leg spring, and a second actuating lever which acts on the trigger lever and which acts on the blocking lever via a second leg spring.

17 Claims, 1 Drawing Sheet

(51) Int. Cl.
*E05B 85/26* (2014.01)
*E05B 85/24* (2014.01)
*E05B 77/04* (2014.01)
*E05B 77/02* (2014.01)

(52) U.S. Cl.
CPC ..... *E05B 77/02* (2013.01); *E05B 77/04* (2013.01); *Y10S 292/22* (2013.01)

(58) Field of Classification Search
USPC ..... 292/216, DIG. 22
See application file for complete search history.

(56) References Cited

U.S. PATENT DOCUMENTS

| | | | | |
|---|---|---|---|---|
| 5,865,481 | A * | 2/1999 | Buschmann | E05B 77/06 292/169.11 |
| 6,971,688 | B2 * | 12/2005 | Drysdale | E05B 77/06 292/216 |
| 7,543,661 | B2 | 6/2009 | Dupont | |
| 7,699,366 | B2 * | 4/2010 | Hanaki | E05B 79/20 292/216 |
| 8,303,004 | B2 * | 11/2012 | Lee | E05B 77/06 292/216 |
| 9,109,380 | B2 | 8/2015 | Mittelbach | |
| 9,243,429 | B2 | 1/2016 | Bendel | |
| 9,534,425 | B2 * | 1/2017 | Hunt | E05B 77/06 |
| 9,593,511 | B2 * | 3/2017 | Hunt | E05B 77/06 |
| 2003/0234544 | A1 | 12/2003 | Jankowski | |
| 2006/0103143 | A1 | 5/2006 | Belmond | |
| 2011/0204690 | A1 | 8/2011 | Torkowski et al. | |
| 2014/0132008 | A1 | 5/2014 | Bendel et al. | |
| 2014/0203575 | A1 * | 7/2014 | Brickner | E05B 77/12 292/341.17 |
| 2015/0315824 | A1 * | 11/2015 | Gotzen | E05B 77/06 292/200 |

FOREIGN PATENT DOCUMENTS

| | | | | |
|---|---|---|---|---|
| DE | 19511651 | A1 * | 10/1995 | E05B 77/06 |
| DE | 19902561 | | 8/2000 | |
| DE | 19902561 | A1 | 8/2000 | |
| DE | 10 2010 010 833 | A1 | 9/2011 | |
| DE | 202010010577 | U1 | 12/2011 | |
| DE | 10 2011 010 816 | A1 | 8/2012 | |
| DE | 102011010815 | A1 | 8/2012 | |
| DE | 10 2012 007002 | A1 | 10/2012 | |
| DE | 202012010950 | | 3/2014 | |
| DE | 10 2012 025 403 | A1 | 6/2014 | |
| EP | 2636826 | A2 * | 9/2013 | E05B 77/06 |
| WO | WO 2009/150225 | A2 | 12/2009 | |

OTHER PUBLICATIONS

Written Opinion dated Feb. 6, 2015 in related PCT/DE2014/100350.
Chinese Office Action issued in related CN201480067080.0 dated Jul. 4, 2017 by the Chinese Patent Office (pp. 6).
German Office Action issued in related DE102013220382.9 (pp. 5).
Machine translation of DE102012007002A1 by Lexis Nexis Total Patent on Oct. 19, 2018 (pp. 26).
Machine translation of DE19902561 by Patent Translate European Patent Office on Oct. 19, 2018 (pp. 18).
Machine translation of DE202010010577U1 by Lexis Nexis Total Patent on Oct. 19, 2018 (pp. 23).
Machine translation of DE202012010950U1 by Patent Translate European Patent Office on Oct. 19, 2018 (pp. 33).
Partial English Translation of Chinese Office Action issued in related CN201480067080.0 (pgs. 3).

* cited by examiner

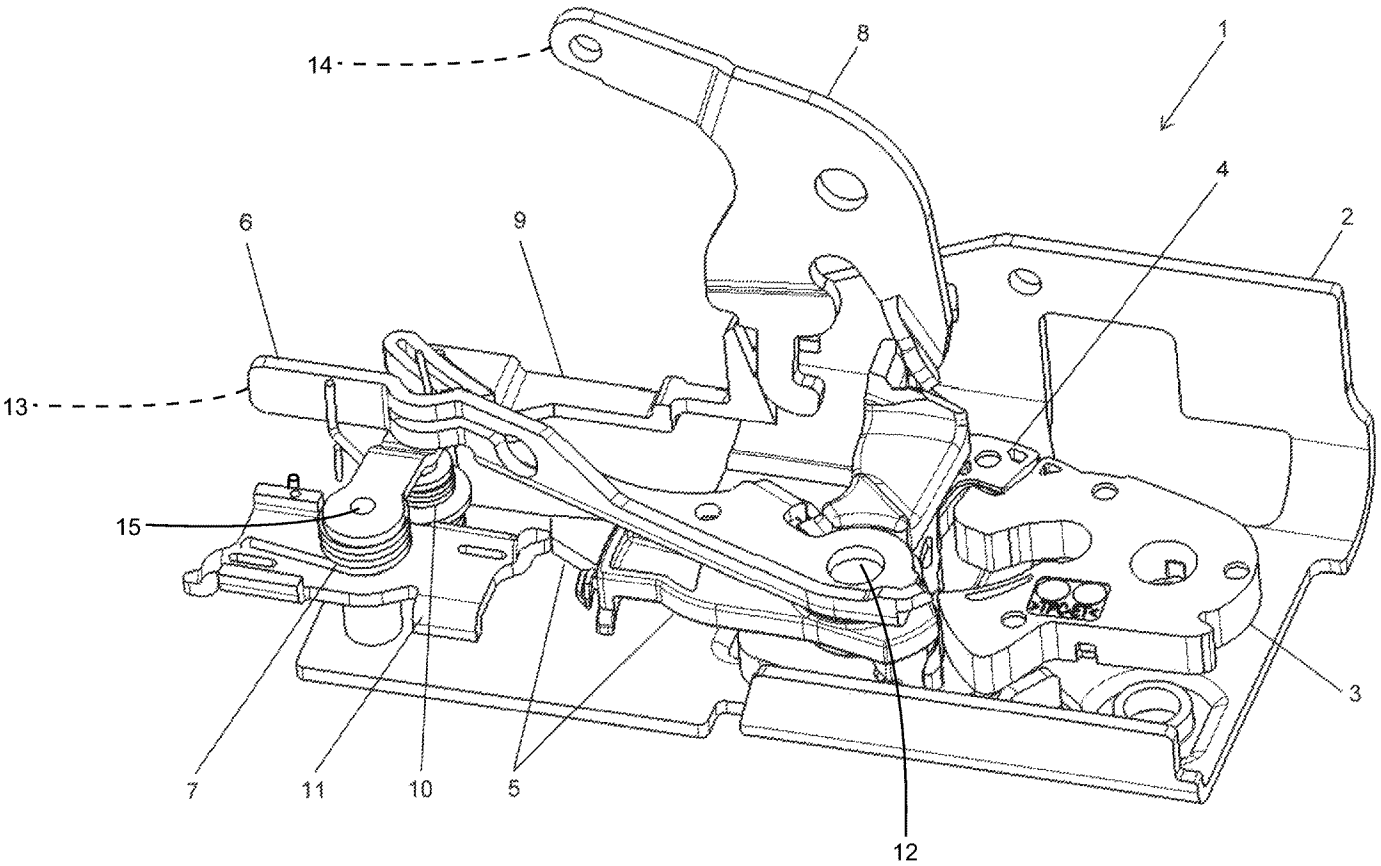
1
2
3
4
5
6
7
8
9
10
11
12
13
14
15

MOTOR VEHICLE DOOR LOCK

BACKGROUND

The present invention concerns a motor vehicle door latch with a locking mechanism with a catch and a pawl. The latch further demonstrates a triggering lever, a blocking lever and two activation levers. The blocking lever prevents rotation of the triggering lever and thus opening of the locking mechanism, if at least one of the activation levers is activated with an activation speed which exceeds a determined threshold. This occurs during an accident, for example, in particular a lateral impact.

The door latch interacts with a locking bolt or equivalently with a locking clip. Usually, the door latch is arranged in the motor vehicle door and the locking bolt on the motor vehicle chassis, but a reverse arrangement is possible. During closure of the motor vehicle door the locking bolt engages into a recess of the catch. Then the catch rotates around its rotational axis. Consequently, the locking bolt is trapped in the catch and thus an opening of the motor vehicle door is prevented. The pawl interacts with the catch by preventing rotation of the catch and thus releasing of the locking bolt. By activation of a handle which is arranged inside or outside of the motor vehicle door, the engagement of the pawl into the catch is released and the catch can be rotated into a position in which the locking bolt can leave the recess and the motor vehicle door can thus be opened.

In the present document the term "door handle" or "handle" means that any handle on the door of a motor vehicle, the activation of which causes the activation of a pertaining activation lever of the motor vehicle latch.

The activation of a door handle is transferred to a pertaining activation lever of the motor vehicle latch, by means of a Bowden cable, for example. In the event of a lateral impact, great accelerations act on the motor vehicle. However, a door handle demonstrates a certain mass inertia. Consequently, the lateral impact can lead to activation of the door handle. However, the activation is jerky with an activation speed which considerably exceeds activation speed caused by a human. This is also the case when the door handle catches on an object. On the basis of the activation speed of the door handle and thus the pertaining activation lever, it can be distinguished whether the locking mechanism will be made inoperative, i.e. if ultimately a rotation of the catch into its release position for the locking bolt will be prevented. An activation speed limit which is defined, for example, as a limit angle speed of an activation lever acts as a threshold for this distinction.

SUMMARY

This functionality enables a motor vehicle door latch in accordance with the independent claim 1. Advantageous design forms are specified in the dependent claims.

The present invention concerns a motor vehicle door latch with a locking mechanism with a catch and a pawl, a triggering lever acting on the pawl, a blocking lever acting on the triggering lever, a first activation lever which acts on the triggering lever and via a first leg spring on the blocking lever, and a second activation lever which acts on the triggering lever and via a second leg spring on the blocking lever.

The pawl prevents, as customary for motor vehicle door latches and already described above, rotation of the catch around its rotational axis by means of which a caught locking bolt is released and the motor vehicle door can be opened. The pawl then engages in the catch. The triggering lever acts on the pawl to trigger the locking mechanism. Rotation of the triggering lever around its rotational axis causes rotation of the pawl around its rotational axis. Consequently, the pawl is released from the engagement with the catch. The rotation of the triggering lever around its rotational axis is caused by the rotation of at least one activation lever around its catch. The rotation of an activation lever around its rotational axis is caused by the activation of a pertaining door handle.

In this document the term "rotational axis" means a virtual line which is vertical on a rotational level in which a point of a component moves if the component is rotated around the rotational axis. However, the term "rotational axis" can describe the actual physical axis around which a component is rotated, for example in the form of a pin.

A leg spring is a sub-form of the screw spring with a fundamentally cylindrical main body typically coiled from spring wire, with two lever-type legs. The main body demonstrates a (virtual) axis which is located in the center of the coil, i.e. defines a central axis of the leg spring. The transmission of force into the leg spring takes place via the leg.

The blocking lever acts on the triggering lever by preventing rotation of the triggering lever around its rotational axis in a blocking position, for example by pushing the triggering lever against the blocking lever and permits rotation of the triggering lever around its rotational axis in a release position. If an activation lever is activated, this activation of the activation lever causes a transition of the blocking lever from its blocking position into its release position, delayed by the leg spring. During this delay time the blocking lever blocks rotation of the triggering lever. During a lateral impact, the duration of the activation of the activation lever caused by the mass inertia of the handle is shorter than the delay time. Consequently, it does not cause timely release of the locking mechanism.

The activation of the activation lever causes a force which is transmitted in one of the legs of the leg springs. The second leg of the leg spring interacts with the blocking lever. As the blocking lever exerts a counterforce on the leg force due to its mass inertia, a deformation of the leg spring occurs which is thus tensed. From a deformation of the leg spring dependent on the spring characteristic curve, the force exerted by the leg spring on the blocking lever overcomes the mass inertia of the blocking lever and causes its transition from the blocking position into the release position. Up to this time, the blocking lever prevents rotation of the triggering lever.

The two activation levers and the triggering lever are preferably designed in such a way that an activation of the activation lever up to a first deflection of the activation lever only causes a movement of the leg of the pertaining leg spring. Only from a second deflection which is larger than the first deflection does the activation of the activation lever cause rotation of the triggering lever. Thus, a latency results between the impact of the activation lever on the leg spring and on the triggering lever. The latency depends on the activation speed of the activation lever. If the latency is greater than the delay time caused by the leg spring, the blocking lever is located in its release position before the activation of the activation lever causes rotation of the triggering lever. Otherwise, the blocking lever blocks rotation of the triggering lever.

The motor vehicle door latch preferably demonstrates a latch case, on which the catch, the pawl, the triggering lever, the blocking lever, the first activation lever and optionally the second activation lever are pivotably located. The latch case is thus a carrier for pivotable components of the motor vehicle door latch. The latch case can form the housing or part of the housing of the motor vehicle door latch.

In a preferred design form of the invention the first activation lever is an external activation lever which can be activated from a door handle on the external side of the motor vehicle, and the second activation lever is an internal activation lever which can be activated by a door handle inside the motor vehicle. In an alternative design, the first activation lever is an internal activation lever and the second activation lever an external activation lever. Thus, the motor vehicle door latch in accordance with the invention enables prevention of the triggering of the locking mechanism in an activation caused by a lateral impact both of an external door handle and also an internal door handle.

The second activation lever can act directly on the second leg spring, i.e. move a leg of the leg spring. In one design form of the invention, the second activation lever acts indirectly on the leg spring, in which the connecting lever or a connecting slider is arranged functionally between the second activation lever and the second leg spring. The second activation lever moves the connecting lever or the connecting slider which in turn acts on the second leg spring. A connecting lever is pivoted by the second activation lever, a connecting slider is moved translationally by the second activation lever. By means of the connecting lever or the connecting slider, a more flexible arrangement of the components in the motor vehicle door latch is possible, in particular a more flexible arrangement of the second activation lever.

In one design form of the invention the connecting lever or connecting slider demonstrates a notch which accommodates an angular end of a first leg of the second leg spring. The second leg of the second leg spring acts on the blocking lever. If the connecting lever or connecting slider is moved by activation of the activation lever, this causes movement of the first leg of the second leg spring which generates tensioning of the second leg spring. As the angular end of the first leg of the second leg spring can move in the notch, a movement of the connecting lever or connecting slider exclusively generates a pivoting movement of the first leg of the second leg spring, but no stretching of this leg.

In one design form of the invention the axis of the first leg spring corresponds to the rotational axis of the blocking lever. For example, if the first leg spring and the blocking lever sit on the same pin, the first leg spring is simultaneously fixed vertically to its axis with regard to movement.

One leg of the first leg spring is preferably connected to the blocking lever in a torque-proof manner with regard to its axis. Movement of this leg of the first leg spring, for example due to rotation of the main body of the first leg spring around its axis thus generates identical rotation of the blocking lever around its rotational axis. To this end, the blocking lever demonstrates a recess, for example, which accommodates an angular end of the leg of the first leg spring. Thus, an interlocking connection results between the angular end of the leg of the first leg spring and the blocking lever.

In one design form of the invention, the rotational axis of the blocking lever is parallel to the rotational axis of the triggering lever. This simplifies blocking of the rotation of the triggering lever by the blocking lever.

In one design form of the invention, the axis of the second leg spring is parallel to the axis of the first leg spring. However, the axes of the two leg springs are preferably not identical.

In one design form of the invention the rotational axes of the pawl, the triggering lever and the first activation lever are identical. The pawl of the triggering lever and the first activation lever are preferably located on the same rotational pin. Thus, a simplified interplay results between the components, in particular between the first activation lever and the triggering lever.

In one design form of the invention the blocking lever and the triggering lever are designed obstructively. This means that the triggering lever prevents a transition of the blocking lever from its blocking position into its release position as long as the triggering lever presses against the blocking lever. To this end, the triggering lever for example demonstrates a protrusion which prevents transition of the blocking lever. Thus, the locking mechanism remains locked until an activation lever is activated.

In an alternative design form the blocking lever and the triggering lever are designed in such a way that the blocking lever can leave its blocking position in the direction of its release position while the triggering lever presses against the blocking lever. Thus, a blocking of the locking mechanism is automatically lifted after expiry of the delay time. Consequently, the motor vehicle door can be opened following an accident, for example.

It is within the scope of the present invention to combine individual design forms both with regard to only one single characteristic and also several characteristics of the design examples to be combined.

The present invention will be explained in further detail on the basis of an enclosed FIGURE. The FIGURE shows a three-dimensional view of the components of a motor vehicle door latch relevant to the invention. Direction information relates exclusively to the depiction in the FIGURE and is thus only explanatory and not restrictive.

BRIEF DESCRIPTION OF THE DRAWING

The FIGURE illustrates a perspective view of a motor vehicle door latch.

DETAILED DESCRIPTION OF THE DRAWING

The motor vehicle door latch 1 demonstrates a latch case 2 which acts as a carrier for further components of the motor vehicle door latch 1. A catch 3 is pivotably arranged on the latch case 2, which demonstrates a recess to accommodate a locking clip not depicted in the FIGURE. Arranged around a common rotational axis 12 on the latch case 2 there is therefore a pawl 4, a triggering lever 5 and an external activation lever 6•as a first activation lever. Of these three components, the pawl 4 is located nearest to the latch case 2, the external activation lever 6 is furthest from the latch case 2 and the triggering lever 5 is between the pawl 4 and the external activation lever 6. The pawl 4 is designed and arranged in such a way that it can prevent a rotation of the catch 3 from its closure position depicted in the FIGURE in a clockwise direction by it being engaged with the catch 3.

An internal activation lever 8 as a second activation lever is pivotably located on a non-depicted latch housing. The direction of the rotational axis of the internal activation lever 8 is vertical to the direction of the rotational axis of the external activation lever 6.

The triggering lever 5 is designed and arranged in such a way that a rotation in an anti-clockwise direction around its rotational axis 12 loosens the pawl 4 from the engagement with the catch 3. To this end, the triggering lever 5 is equipped for example with a pin as a type of tappet which is engaged into a recess in the pawl 4.

Such a rotation of the triggering lever 5 is generated by the activation of at least one of the activation levers 6 and 8. To this end, each of the activation levers 6 and 8 demonstrates a functional surface which can interact with a corresponding functional surface of the triggering lever 5 in order to rotate it around its rotational axis in an anti-clockwise direction. A relevant activation of an activation lever 6 or 8 occurs in the installed state of the motor vehicle door latch 1 by means of the activation of a relevant door handle 13 or 14 which causes activation of the pertaining activation lever 6 or 8.

Arranged further on the latch case 2 there is a blocking lever 11 which is pivotably located around a rotational axis 15. The rotational axis 15 of the blocking lever 11 is parallel to the rotational axis of the pawl 4, the triggering lever 5 and the external activation lever 6. The blocking lever 11 can also assume a release position in addition to its blocking position depicted in the FIGURE. In its blocking position, the blocking lever 11 prevents a rotation of the triggering lever 5 in an anti-clockwise direction and thus a triggering of the engagement of the pawl 4 into the catch 3.

Around the same rotational pin and axis 15 as the blocking lever 11 a first leg spring 7 is arranged, the central axis of which coincides with the rotational axis of the blocking lever 11. An angular end of a leg of the first leg spring 7 stretches in an interlocking manner into a recess of the blocking lever 11. An angular end of another leg of the first leg spring is adjacent to a surface of the external activation lever 6.

Analogously to the external activation lever 6 the internal activation lever 8 is also connected to the blocking lever via a leg spring. In the present execution example, a second leg spring 10 is arranged on the latch case 2. The axis of the second leg spring 10 is parallel to the axis of the first leg spring 7. The motor vehicle door latch 1 further demonstrates a connecting slider 9 which can execute a one-dimensional translational relative movement vis-à-vis the latch case 2. In the FIGURE this relative movement occurs from left to right and vice versa.

The connecting slider 9 demonstrates a notch running diagonally vis-à-vis its direction of movement which accommodates an angular end of the second leg spring 10. The other leg of the leg spring 10 is adjacent on a lateral surface of the blocking lever 11.

An activation of the internal activation lever 8 causes a one-dimensional translational shifting of the connecting slider 9, in the present depiction to the left. Thus, the leg of the second leg spring 10 connected to the connecting slider 9 is rotated around its axis. In the process, the wound end of this leg glides in the notch in the connecting slider 9.

During activation of the external activation lever 6 this initially only exerts a force on the adjacent leg of the first leg spring 7, the mass inertia of the blocking lever 11 exerts a force on the other leg of the first leg spring 7. The external activation lever 6 is not yet in contact with the triggering lever 5. Thus, the external activation lever 6 tenses the first leg spring 7 against the mass inertia of the blocking lever 11. It is noted that a frictional force is also additional to the mass inertia force. Consequently, a counterforce of the blocking lever 11 can be spoken of overall.

From a limiting stress of the first leg spring 7 the force exerted by the leg spring 7 on the blocking lever 11 exceeds its counterforce and causes a rotation of the blocking lever 11 from its blocking position depicted in the FIGURE into its release position. If this transition occurs before the external activation lever 6 comes into contact with the triggering lever 5, the triggering lever 5 can rotate around its rotational axis. This is with an activation speed which is below the activation speed limit.

With a greater activation speed the blocking lever 11 is still in its blocking position when the external activation lever 6 comes into contact with the triggering lever 5, and thus prevents rotation of the triggering lever 5. Thus, in the case of a greater activation speed, as generated during a lateral impact, for example, a release of the catch 3 is prevented by the pawl 4 because the triggering lever 5 is blocked by the blocking lever 11.

Analogously to the process in the activation of the external activation lever 6 an activation of the internal activation lever 8 initially leads solely to a tensioning of the second leg spring 10 before the internal activation lever 8 comes into contact with the triggering lever 5. If the force exerted on the blocking lever 11 by the tensioned second leg spring 10 exceeds its counterforce, this thus moves from its blocking position into its release position. Only following a further activation of the internal activation lever 8 does this come into contact with the triggering lever 5 and it rotates around its rotational axis, if the blocking lever 11 is in its release position until then.

A very short, jerky activation of an activation lever with an activation speed above an activation speed limit therefore leads to the triggering lever 5 being blocked by the blocking lever 11 during the activation period and thus a triggering of the locking mechanism consisting of a catch 3 and a pawl 4 is prevented.

In the present execution example, the activation levers 6 and 8 and the triggering lever 5 are arranged and designed in such a manner that an activation of an activation lever exerts an (additional or increased) force on the pertaining leg spring before the functional surface of the activation lever interacts with a pertaining functional surface of the triggering lever 5 in order to rotate the triggering lever 5 around its rotational axis. The start of the activation of the activation levers 6 or 8 thus initially acts only on the leg spring 7 or 10 and thus on the blocking lever 11, however still not on the triggering lever 5. Thus, a slow activation of an activation lever 6 or 8 initially causes rotation of the blocking lever from its blocking position into its release position, before a rotation of the triggering lever 5 around its rotational axis.

A core aspect of the present invention is that both activation levers 6 and 8 respectively act via a leg spring 7 or 10 on a single, common blocking lever 11. Thus, also in the case of a motor vehicle door which demonstrates a door handle on the inside and the outside respectively, an unintentional unbolting of the motor vehicle door latch by the mass inertia of a door handle during a lateral impact can be prevented.

The invention claimed is:

1. A motor vehicle door latch that resists opening in the event of an impact caused by the accident, the motor vehicle door latch comprising:

a catch having a closed position;

a pawl operable to hold the catch in the closed position;

a triggering lever operable to move the pawl;

a blocking lever operable to hold the triggering lever in a position where the triggering lever cannot move the pawl, wherein the blocking lever has a mass having a mass inertia that resists movement of the blocking lever;

a first activation lever operably connected to a first handle and operably connected to the triggering lever;

a first leg spring operatively connecting the first activation lever to the blocking lever, wherein the first leg spring creates a first delay between movement of the first activation lever and movement of the blocking lever, wherein the first delay is longer than a first duration of movement of the first activation lever caused by the impact, and wherein, after the first delay, the first leg spring moves the blocking lever out of the position where the triggering lever cannot move the pawl;

a second activation lever operably connected to a second handle and operably connected to the triggering lever; and a second leg spring operatively connecting the second activation lever to the blocking lever, wherein the second leg spring creates a second delay between movement of the second activation lever and movement of the blocking lever, wherein the second delay is longer than a second duration of movement of the second activation lever caused by the impact, and wherein, after the second delay, the second leg spring moves the blocking lever out of the position where the triggering lever cannot move the pawl.

2. The motor vehicle door latch of claim 1, further comprising a slider that operatively connects the second activation lever to the second leg spring.

3. The motor vehicle door latch of claim 2, wherein the slide defines a notch that accommodates the second leg spring.

4. Motor vehicle door latch in accordance with claim 1, wherein an axis of the first leg spring corresponds to a rotational axis of the blocking lever.

5. Motor vehicle door latch in accordance with claim 4, wherein the rotational axis of the blocking lever is parallel to the rotational axis of the triggering lever.

6. Motor vehicle door latch in accordance with claim 5, wherein an axis of the second leg spring is parallel to the axis of the first leg spring.

7. Motor vehicle door latch in accordance with claim 6, wherein a rotational axis of the pawl, of the triggering lever and the first activation lever are identical.

8. Motor vehicle door latch in accordance with claim 7, further comprised by a recess in the blocking lever, which accommodates the first leg spring.

9. Motor vehicle door latch in accordance with claim 1, further comprising a connecting lever via which the second activation lever acts on the second leg spring.

10. Motor vehicle door latch in accordance with claim 9, wherein the connecting lever defines a notch which accommodates the second leg spring.

11. Motor vehicle door latch in accordance with claim 1, wherein an axis of the first leg spring corresponds to a rotational axis of the blocking lever.

12. Motor vehicle door latch in accordance with claim 1, wherein a rotational axis of the blocking lever is parallel to a rotational axis of the triggering lever.

13. Motor vehicle door latch in accordance with claim 1, wherein an axis of the second leg spring is parallel to an axis of the first leg spring.

14. Motor vehicle door latch in accordance with claim 1, wherein a rotational axis of the pawl, of the triggering lever and the first activation lever are identical.

15. Motor vehicle door latch in accordance with claim 1, further comprised by a recess in the blocking lever, which accommodates the first leg spring.

16. A method of operating a motor vehicle door latch, the method comprising:

providing the motor vehicle door latch of claim 1;

by an operator actuating the first handle, moving the first activation lever which compresses the first leg spring;

after the first delay, moving the locking due to the compression of the first leg spring thereby moving the blocking lever out of the position where the triggering lever cannot move the pawl.

17. The method of claim 16, further comprising:

by the accident, moving the first activation lever which compresses the first leg spring;

before the first delay, moving the first activation lever back to a starting position due to the compression of the first leg spring.

* * * * *